US005421557A

United States Patent [19]

Vise

[11] Patent Number: 5,421,557

[45] Date of Patent: Jun. 6, 1995

[54] FENCE SYSTEM

[75] Inventor: Larry L. Vise, Birmingham, Ala.

[73] Assignee: Alabama Metal Industries Corporation, Birmingham, Ala.

[21] Appl. No.: 58,577

[22] Filed: May 6, 1993

[51] Int. Cl.[6] ..... E04H 17/16

[52] U.S. Cl. ..... 256/24; 256/21; 256/54; 256/22; 248/74.5; 411/399; 52/581; 52/483.1

[58] Field of Search ..... 256/24, 32, 33, 54–55, 256/9, 5, 21–22, 29, 45–48, DIG. 3; 245/11; 411/399, 187, 188; 248/74.5, 301, 304, 227; 52/581, 478, 483.1

[56] References Cited

U.S. PATENT DOCUMENTS

| | | | |
|---|---|---|---|
| 297,382 | 4/1884 | Golding . | |
| 834,873 | 10/1906 | Curtis . | |
| 1,902,966 | 3/1933 | MacChesney . | |
| 2,053,254 | 9/1936 | Fairchild et al. . | |
| 3,022,044 | 2/1962 | Gugino | 256/47 |
| 3,592,492 | 7/1971 | Lind | 52/581 |
| 4,286,772 | 9/1981 | Parisien | 256/21 X |
| 4,471,947 | 9/1984 | Osborne | 256/24 |
| 4,526,347 | 7/1985 | McLoughlin | 256/33 |
| 4,854,114 | 8/1989 | Speck | 411/399 X |
| 5,255,898 | 10/1993 | Cacicedo | 256/54 X |

FOREIGN PATENT DOCUMENTS

| | | | |
|---|---|---|---|
| 215001 | 5/1961 | Australia . | |
| 834046 | 11/1938 | France | 256/35 |
| 3245857-A1 | 6/1984 | Germany . | |

*Primary Examiner*—Dave W. Arola
*Assistant Examiner*—Harry C. Kim
*Attorney, Agent, or Firm*—Trexler, Bushnell, Giangiorgi & Blackstone, Ltd.

[57] ABSTRACT

A fence system including a frame and a plurality of foraminous panels attached to the frame. The foraminous panels are constructed with continuous integral strands which are connected by integral bonds extending between each of the strands. The integral strands form a zig-zag pattern defining cell apertures therebetween. The cell apertures define a non-circular interior shape. A fastener of the fence system has a shank and a head attached to one end of the shank. A shoulder positioned between the shank and the head is shaped to cooperatively engage a cell aperture for preventing rotation of the fastener when engaged with a foraminous panel. The foraminous panels are attached to the frame with a portion of each neighboring panel having an overlapping area through which fasteners are inserted and attached. An angled top edge cap is attached along a top end of the foraminous panels and is angled to deter climbing. The top cap material is formed of foraminous panels having cell apertures generally smaller than lower panels. The top cap panel material is self-supporting but is incapable of supporting the weight of a climber. Additionally, barbed segments are formed along a terminal edge of the top cap by shearing one of the integral strands to provide extremely sharp pointed tips.

23 Claims, 5 Drawing Sheets

20
22
24
26
28
30
32
34
36
24a
24b
49
49a
49b
51
48
46
50
52
54
57
58
60
64
10
83
84
3

FENCE SYSTEM

BACKGROUND OF THE INVENTION

This invention pertains to fence systems and more particularly to fence systems including panels attachable to frames with the panels also being attachable over existing woven fabric fence material.

Fence systems and fence materials come in a wide variety of configurations. One of the most common types of fence systems uses chain link fence material (also known as hurricane or cyclone fencing). The chain link fence system includes a woven "chain link" fence material which is stretched over and attached to a structural frame. The woven material includes a series of interlinking fence pickets. The fence pickets have a characteristic zig-zag pattern which facilitates the interlinking of the pickets. Each of the interlinking pickets is an independent body which is woven with neighboring pickets on each side. Often, terminal portions of the pickets are twisted on one end and knuckled on the other end to help retain the woven structure.

A frame used with a chain link fence system includes a series of vertical and non-vertical segments or posts and rails. The woven material is unrolled from large bails of material and cut to a desired length. Cutting involves separating the twisted terminal ends of the pickets or cutting off such terminal ends and unweaving one of the pickets from its neighbors. The selected piece of woven material is placed against the frame and stretched to mount the material against the frame in a tensioned manner. In this regard, the chain link fabric must be tensioned between at least two vertical segments of the frame.

The chain link fence system has several problems. First, the woven material, while providing a degree of deterrence, can be defeated quite easily. Because the chain link system employs a woven material, removal of one of the pickets allows a portion of the fence to be unraveled or spread apart in a curtain-like manner. As noted above, the pickets are easily removable by removing terminal ends of each picket and merely unweaving the picket from its neighboring pickets.

An informal study indicates that a person skilled at penetrating chain link fence systems can create an opening in the woven material sufficient to drive a small car through in less than one minute.

An additional problem with the woven material used in chain link fencing systems is that it is easily climbable. The size and orientation of the chain link material forms a space sufficient for gripping and for providing a toehold to ease a climbers ascent. Additionally, the pickets are formed of a rounded wire material which provides a comfortable grip with no deterrent effect. As a result of these characteristics of the chain link material an intruder can quickly and easily climb the chain link fence system.

Various top cap barriers have been created in an attempt to deter climbing over the top of chain link fence systems. One type of top cap barrier employs an unraveled coil of barbed or razor tape wire mounted to the top of the chain link material. In many cases, the razor wire can be spread or pushed out of the way thus allowing a skilled intruder to easily pass over this type of top cap barrier.

In an attempt to overcome the ease which an intruder can pass over the coiled top cap material, an angled top cap was devised employing a series of barbed wire or razor tape wire rows. Once again, a sufficiently skilled and motivated intruder can actually employ these rows to support his weight while climbing over the top of such a structure.

Fence systems are increasingly more important to provide an initial perimeter barrier to secure items of value. As an example, many rail transfer yards are large expansive areas in which large quantities of valuable goods are stored while being transferred within the rail shipping system. Such a temporary storage area is especially prone to theft and vandalism due to the expansive nature of the transfer yard and the inability to constantly monitor all areas of such a facility.

In an attempt to improve security, fences are erected around the perimeter of such a yard to deter casual intrusion. Skilled and motivated intruders easily scale or penetrate ordinary chain link fence systems. Video cameras and electronic monitors are often positioned to provide early warning as to penetration or intrusion. These systems, however, are somewhat easy to foil.

Even when a monitoring system is not foiled by an intruder, often times the size of such a rail transfer yard will result in sufficiently long response time to allow an intruder to steal or vandalize the contents of the yard. A lengthy response time is exacerbated by the extremely short time required to penetrate a chain link fence system. In other words, even though an intruder may be detected as entering the yard, the penetration time is so short and the yard area is so large that a security detail often times cannot get to the scene of the intrusion or theft in sufficient time to apprehend the intruders.

An additional problem with chain link fence systems is that they allow a convenient way for intruders to repeatedly penetrate and exit the perimeter barrier. In this regard, since the woven fence material can be unraveled, it can also be quickly, temporarily reconnected so as to appear to not have been breached. As such, once an intruder opens the woven fabric, if undetected while inside the perimeter, they can exit the same spot and try to repair the spot in an easily disassembled manner to use the same entry point on another visit. The repair can be made using small gauge wire which can be easily cut on the next visit. Often times, containers or other objects placed in front of the repaired point of penetration will obscure the breach in the fencing material from being located during a casual inspection.

As a result of the problems noted above, the defensive abilities of woven fence material of chain link fence systems has declined as the ability and motivation of intruders has increased. Additionally, the cost of securing an area has dramatically increased due to the need to provide additional monitoring of the perimeter barrier including expensive sensing and observation equipment and employees to operate and monitor such equipment. Additionally, even though monitoring equipment is employed, such equipment is prone to vandalism and ordinary break down thereby providing weak links in the overall security system. Due to the intruder skill and motivation of intruders and the frequency of intrusions insurance rates continue to climb. As a result of increasing intrusions, insurance costs and the cost of goods covered by such insurance continue to increase dramatically.

It is highly desirable to provide a fence system which is difficult to penetrate and climb in order to provide a highly reliable perimeter security barrier.

OBJECTS AND SUMMARY OF THE INVENTION

A general object of the present invention is to provide a fence system which is highly reliable, impregnable and does not require extensive monitoring.

Another object of the present invention is to provide a fence system which prevents intrusion by climbing over the fence system.

Yet another object of the present invention is to provide a fastener for use with a fence system which is highly resistant to removal for securely fastening a number of fence panels to one another and to a structural framework.

Yet another object of the present invention is to provide a fence system which can be erected independent of the location of the frame and which can be attached over existing chain link woven material fence systems.

Briefly, and in accordance with the foregoing, the present invention envisions a fence system including a frame and a plurality of foraminous panels attached to the frame. The foraminous panels are constructed with continuous integral strands which are connected by integral bonds extending between each of the strands. The integral strands form a zig-zag pattern defining cell apertures therebetween. The cell apertures define a non-circular interior shape. A fastener of the fence system has a shank and a head attached to one end of the shank. A shoulder positioned between the shank and the head is shaped to cooperatively engage a cell aperture for preventing rotation of the fastener when engaged with a foraminous panel. The foraminous panels are attached to the frame with a portion of each neighboring panel having an overlapping area through which fasteners are inserted and attached. An angled top edge cap is attached along a top end of the foraminous panels and is angled to deter climbing. The top cap material is formed of foraminous panels having cell apertures generally smaller than lower panels. The top cap panel material is self-supporting but is incapable of supporting the weight of a climber. Additionally, barbed segments are formed along a terminal edge of the top cap by shearing one of the integral strands to provide extremely sharp pointed tips.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which.

DETAILED DESCRIPTION OF THE PREFERRED EMBODIMENT

Figures 1, 2, 2A:
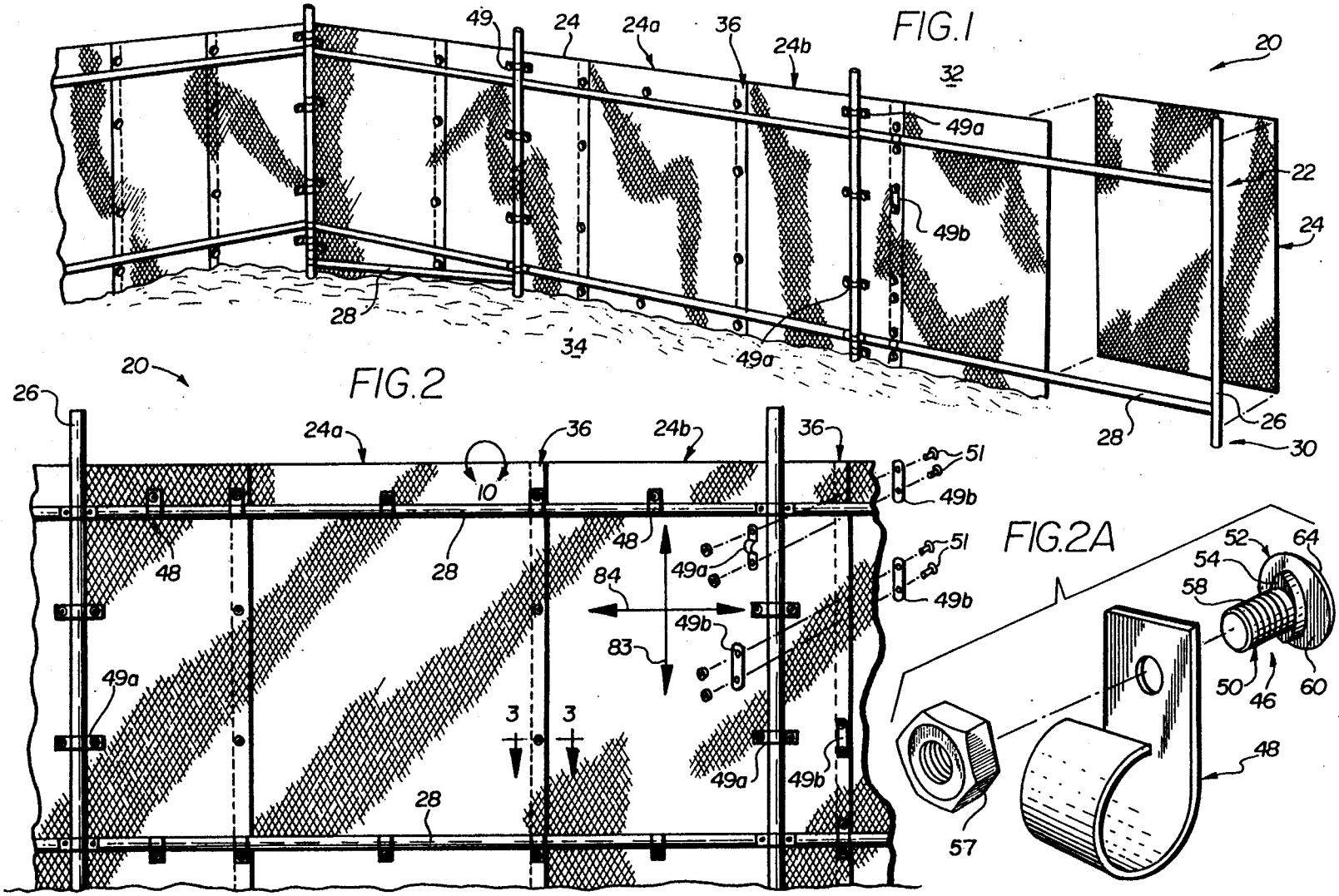
FIG. 1 is a perspective view of a fence system of the present invention as viewed from a secure side of a barrier defined by the fence system.
FIG. 2 is an enlarged, partial fragmentary, elevational view of the fence system as shown in FIG. 1 showing foraminous panels overlapping and being fastened to neighboring panels.
FIG. 2A is an enlarged, exploded, perspective view of a fastener and a single-sided fitting used in the fence system as shown in FIGS. 1 and 2.

While the invention may be susceptible to embodiment in different forms, there is shown in the drawings, and herein will be described in detail, an invention with the understanding that the present description is to be considered an exemplification of the principles of the invention and is not intended to limit the invention to that as illustrated and described herein.

FIG. 1 provides a perspective view of a fence system 20 which includes a frame 22 and a plurality of foraminous panels 24 which are attachable to the frame 22. The frame 22 includes vertical segments or posts 26 and non-vertical segments or rails 28. When the panels 24 are attached to the frame 22 the fence system defines a barrier 30 having an attack side 32 and a secure side 34.

Figure 4:
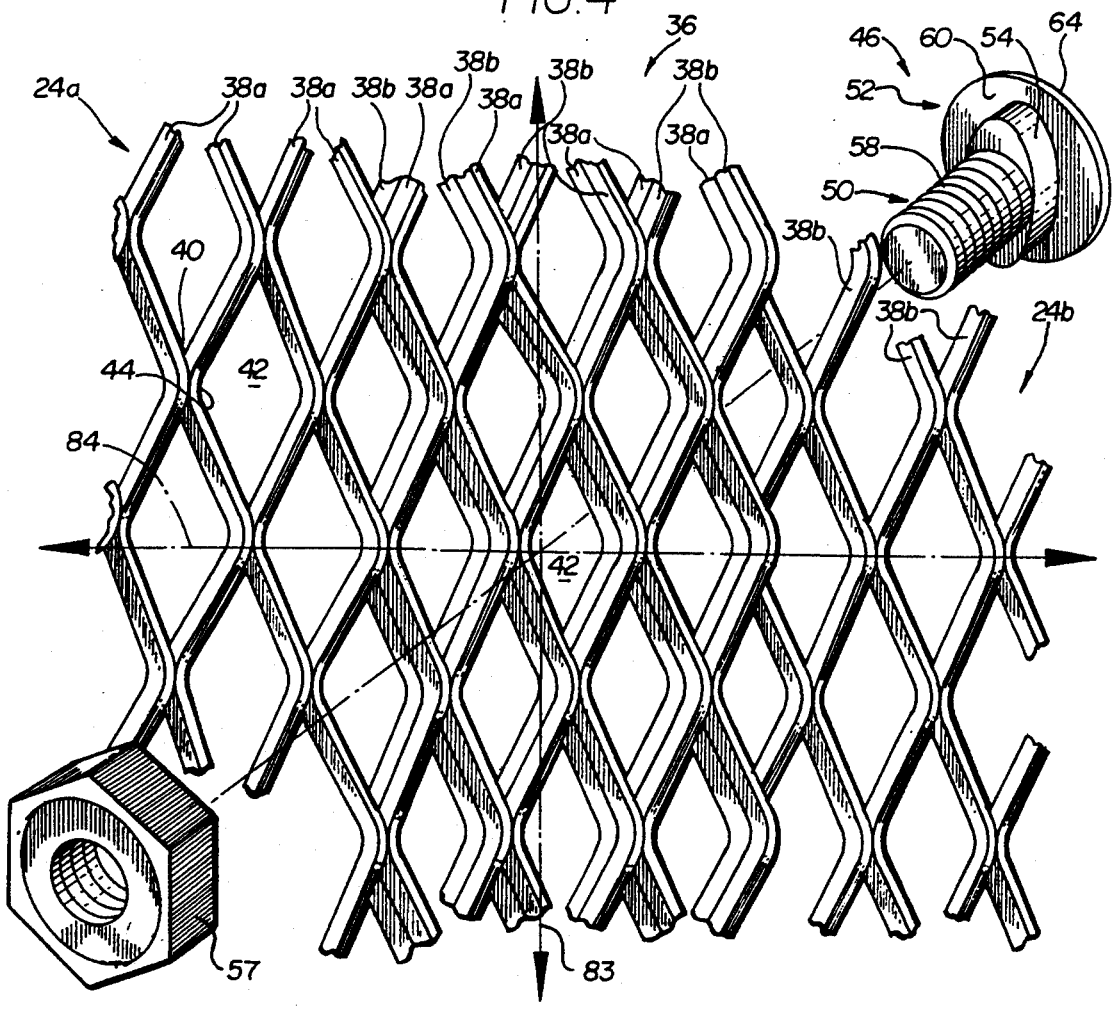
FIG. 4 is an enlarged, partial fragmentary, exploded, perspective view of the fastener and nut as shown in FIGS. 2 and 3.
Figure 5:
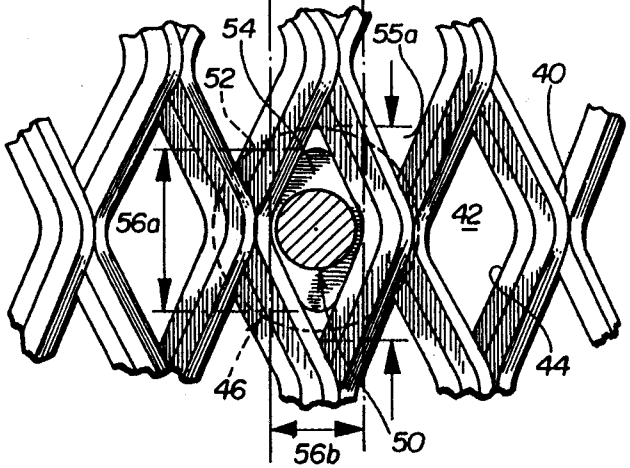
FIG. 5 is an enlarged, partial fragmentary, cross-sectional, elevational view of the fastener taken along line 5—5 in FIG. 3 showing a shoulder of the fastener engaged with a cell aperture in the overlapping area of the nested foraminous panels.

FIGS. 4 and 5 provide enlarged detail views of partial fragmentary sections of the foraminous panels 24. Each panel 24 is comprised of a plurality of integral strands 38 and integral bonds 40 formed between, and integrally joining, neighboring strands 38. As such, each strand 38 is integrally connected at spaced apart locations by integral bonds 40 with at least one neighboring strand 38. The integral strands 38 and bonds 40 are formed by slitting or shearing a continuous metal plate and expanding the plate along the sheared lines. A product formed by this process is known as "expanded metal".

Figure 3:
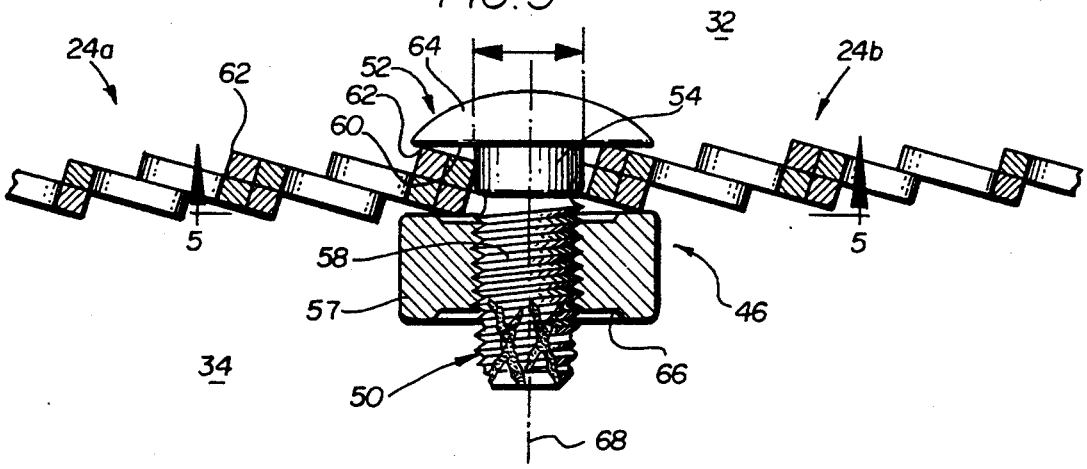
FIG. 3 is a partial fragmentary, cross-sectional, plan view taken along line 3—3 in FIG. 2, showing a fastener extending through an overlapping area of two nested foraminous panels.

The strands 38 are generally vertically oriented to minimize the horizontal surface effect of the panel 24 thereby eliminating finger grips and toeholds which might otherwise be available to a climbing intruder. As shown in FIG. 3, the vertically oriented strands provide a vertically oriented surface essentially devoid of any horizontal gripping features.

Cell apertures 42 are defined between neighboring strands 38 of the foraminous panel 24 and at least two spaced-apart bonds 40. The cell apertures 42 define a non-circular interior surface 44. With reference to FIGS. 4, the overlapping area 36 of two neighboring panels 24a,24b results in the strands 38a of one panel 24 nesting against the strands 38b of the second panel. In other words, as shown in FIG. 4, the strands 38a of a first panel 24a nest against the strands 38b of a neighboring second panel 24b. The nesting of the two panels 24a, 24b enhances the security effect of the panels 24 in the overlapping area 36 as shown in FIG. 1.

Figure 2B:
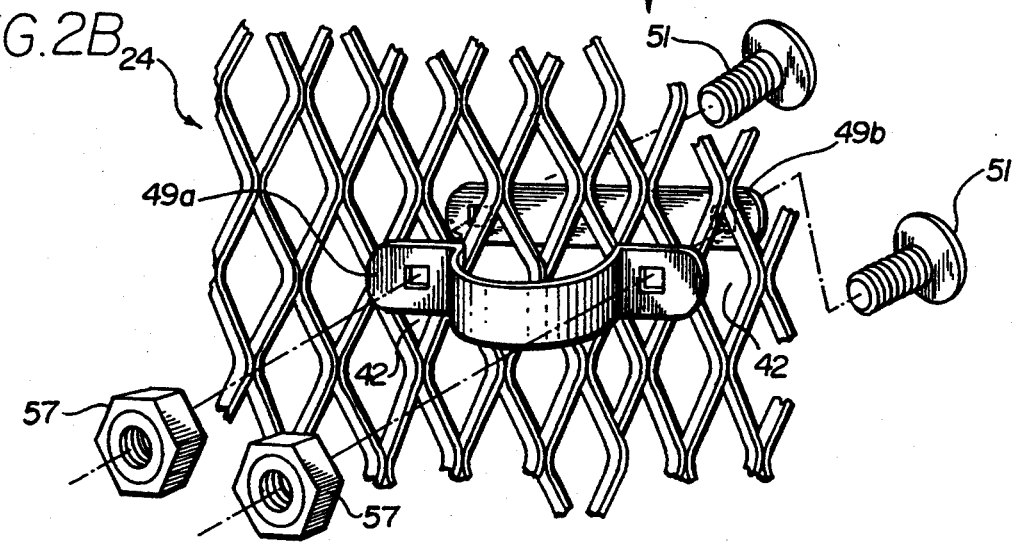
FIG. 2B is an enlarged, exploded, perspective view of a two-sided fitting used in the fence system as shown in FIGS. 1 and 2.
Figure 6:
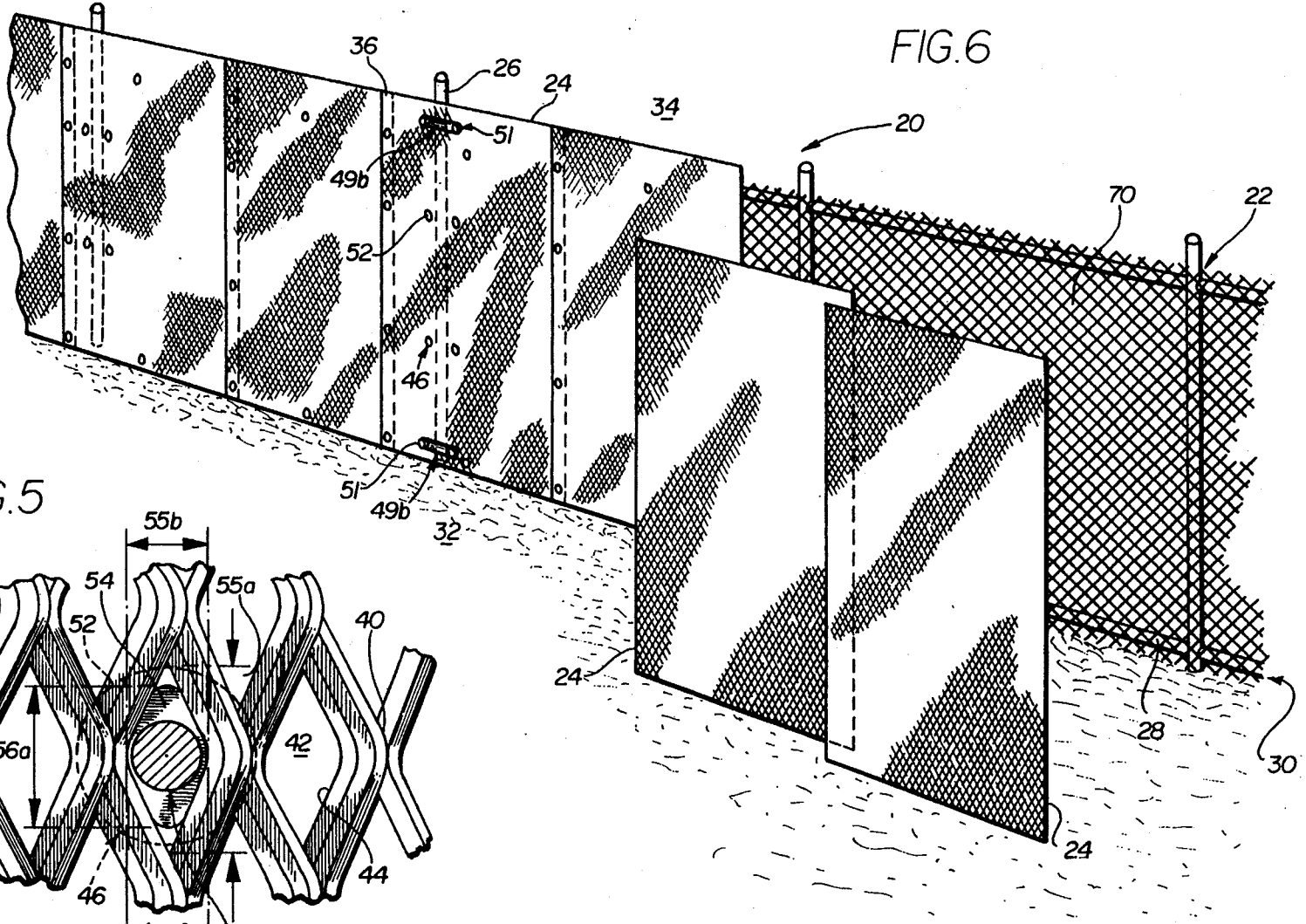
FIG. 6 is a partial fragmentary, perspective view of the fence system of the present invention in which panels are attached to an existing woven material fence.

With further reference to FIGS. 3–5, a fastener 46 extends through a selected cell aperture 42 of at least one panel 24, and preferably the cell apertures of two nested, overlapping panels. As can be seen in FIGS. 1, 2, 6, and with further reference to FIGS. 2A and 2B, the fastener can also be used to attach a panel 24 to a single-sided fitting (as shown in FIG. 2A), a pre-curved, two-sided fitting 49a (as shown in FIG. 2B), and a flat two-sided fitting 49b. Additionally, the fittings 48,49a,49b can be attached to the fence system 20 using common fasteners 51 as shown in FIGS. 2 and 2B.

The single-sided fitting 48 is attached using a fastener 46 or 51 and is retained on the secure side 34 of the fence system 20. As shown in FIGS. 1 and 2, the single-sided fitting 48 can be used to attach a panel 24 to both the posts 26 as well as the rails 28. The two-sided fitting 49b is vertically oriented over an overlapping area 36. The fitting 49b includes a pair of apertures formed therethrough for receiving a fastener 46, or 51. The fasteners 46 or 51 are inserted through the attack side 32 of the panel 24 and extend through corresponding cell apertures 42 and through the apertures in the fitting 49b. As shown in the exploded view of the fitting 49b, two plates are provided with the plate on the attack side 32 preventing the fastener 51 from passing through the cell aperture 42. The pre-curved, two-sided fitting 49a functions in essentially the same manner as the fitting 49b except that the center portion of the fitting 49a is curved to straddle a post 26 or a rail 28 (the post or rail 26,28 is omitted from FIG. 2B in the interest of clarity).

The fastener 46 includes a shank 50 and a head 52 on one end of the shank 50. A shoulder 54 of the fastener 46 is positioned between the shank 50 and the head 52. The shoulder 54 has a non-circular outside shape which is cooperatively formed for engaging the non-circular inside surface 44 of the cell aperture 42. As shown in FIGS. 3 and 5, the non-circular shape of the shoulder 54 prevents rotation of the fastener 46 in the cell aperture 42.

The shoulder has a generally diamond shape as does the cell aperture 42. The cell aperture 42 has a major axis 55a and a minor axis 55b. The shoulder 54 has a first axis 56a and a second axis 56b. The dimension of the second axis 56b is substantially equal to the minor axis 55b of the cell aperture 42 and the dimension of the first axis 56a ranges from substantially equal to the minor axis 55b to substantially equal to the major axis 55a.

A retaining portion 57, shown in the illustrations as a nut, threadedly engages cooperatively formed threads 58 formed on the shank to hold the fastener 46 in engagement with a panel 24. Tightening of the nut 57 on the shank 50 draws the shoulder 54 into intimate engagement with the inside surface 44 of the cell aperture 42.

As shown in FIG. 3, an abutting surface 60 of the head 52 abuts crests 62 of neighboring strands 38 to shield the shank 50 and the shoulder 54. Shielding of the shank 50 and shoulder 54 prevents an intruder from wedging a tool between the head 52 and the panels 24 to knock the head off of the fastener to dislodge the fastener 46 from the panels 24. As an additional deterrent, the head 52 has a convex surface 64 which resists gripping. Further, the threads 58 of the fastener 46 are scarified or damaged to prevent removal of the nut 57 from the fastener 46. A recess 66 on the nut 57 allows the threads to be scarified further along an axis 68 of the shank thereby preventing disengagement of the nut 57 from the shank 50.

With reference to FIG. 1, the nuts are on the secure side 34 of the barrier 30. FIG. 6 provides a view of the fence system 20 of the present invention attached to an existing woven fence material or chain link material 70 in showing the heads 52 positioned on the attack side 32.

Figure 7:
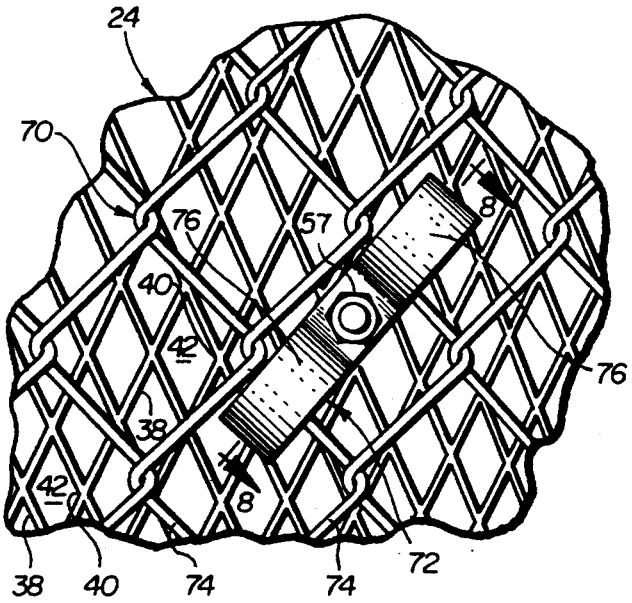
FIG. 7 is an enlarged, partial fragmentary, elevational view of a bracket used to secure foraminous panels to woven fabric material.

With further reference to FIG. 6, panels 24 are attached directly over existing woven fence material 70. The panels 24 include the overlapping area 36 as described hereinabove. FIG. 7 provides an enlarged view of a panel 24 attached over existing woven fence material showing a bracket 72 which is employed to secure the panel 24 to the chain link material 70. As can be seen in FIG. 7, the chain link material 70 includes a series of interlinking zig-zag pickets 74 which engage and interlink with neighboring pickets 74,74.

Figure 8:
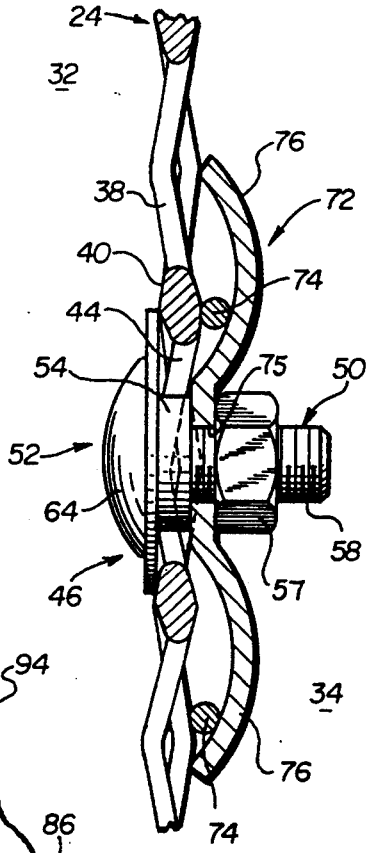
FIG. 8 is a partial fragmentary, cross-sectional, plan view of the bracket in FIG. 7 taken along line 8—8 in FIG. 7.

The bracket 72 is mounted to the secure side 34 of the barrier 30, with the shank 50 of a fastener 46 extending through an aperture 75 formed through a center section of the bracket 72. As further shown in the side view of FIG. 8, two arms 76 of the bracket 72 extend to overlie at least two pickets 74. The fastener 46 is inserted through a cell aperture 42 of the panel 24 from the attack side 32. As such, only the convex surface 64 of the head 52 is exposed to the attack side 32. The bracket 72 is engaged with the fastener 46 on the secure side 34. As described hereinabove, the shoulder 54 of the fastener 46 prevents rotation of the fastener 46 and the nut 57 secures the bracket 72 against the secure side 34 of the woven fence material 70.

Figure 9:
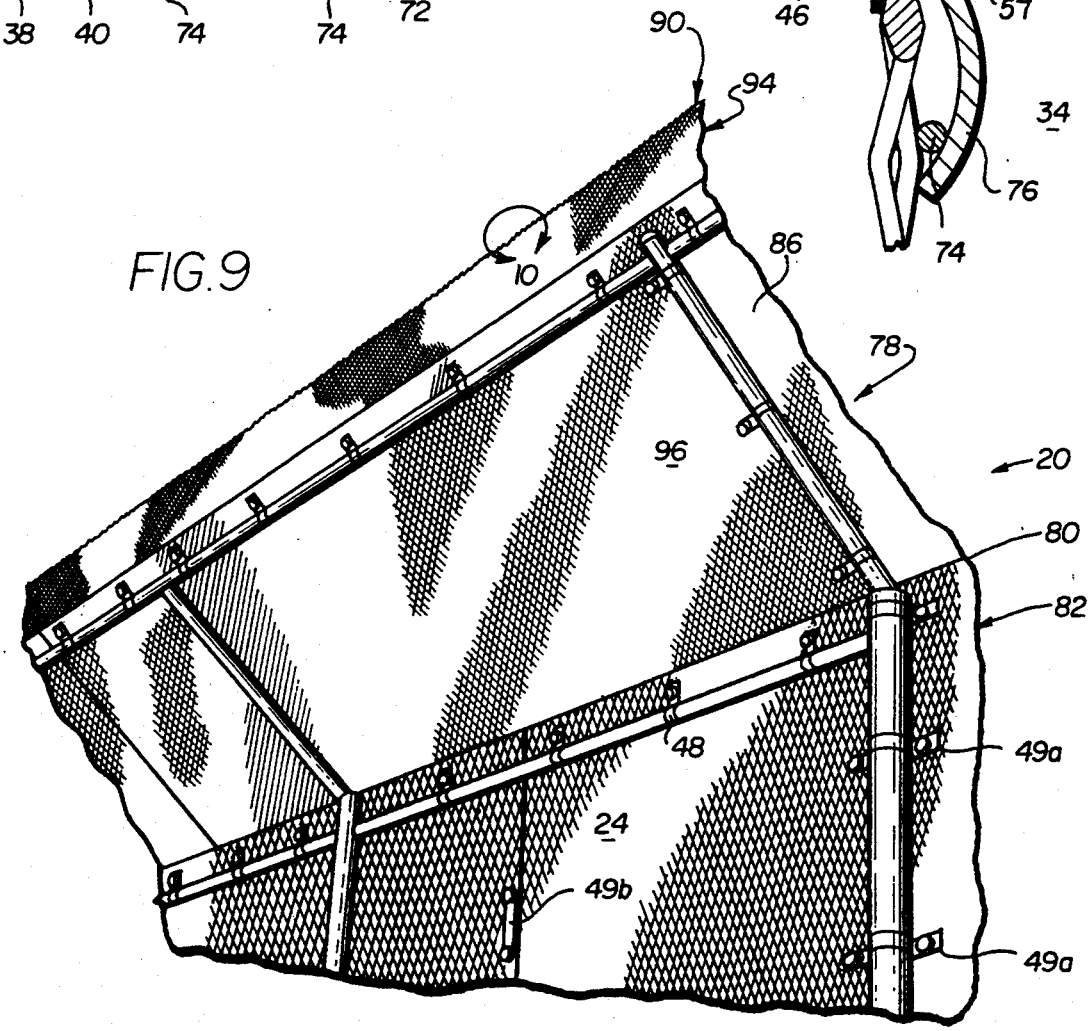
FIG. 9 is a partial fragmentary, perspective view of a top cap attached to lower panels of the fence system.

FIG. 9 provides an illustration of a top cap 78 of the fence system 20 attached along a top edge 80 of lower panels 82. The lower panels 82 are configured as described hereinabove with reference to FIGS. 1–8. With further detailed reference to FIG. 4, panels 24 are formed by expanding a continuous metal sheet which has been slit in a predetermined pattern. The integral strands 38 in the panel are oriented in a longitudinal direction along a strand axis 83. As such, each panel 24 is elongated along a direction of expansion (as indicated by arrow 84 in FIG. 4) generally perpendicular to the strand axis 83.

Referring back to FIG. 9, the lower panels 82 are oriented with strands axes 82 in a vertically aligned direction. The top cap 78 is constructed with panels 86 having the strand axis 83 directed horizontally or, in other words, perpendicular to the strand axis 83 of the lower panels 82. Additionally, the top cap 78 panels 86 have a cell aperture 42 which is smaller than a cell aperture of the lower panels 82. By orienting the strand axis 83 of the top cap 78 panels 86 perpendicular to the strand axis 83 of the lower panels 82, a barbed segment 88 can be achieved along a terminal edge 90 of the top cap 78.

Figure 10:
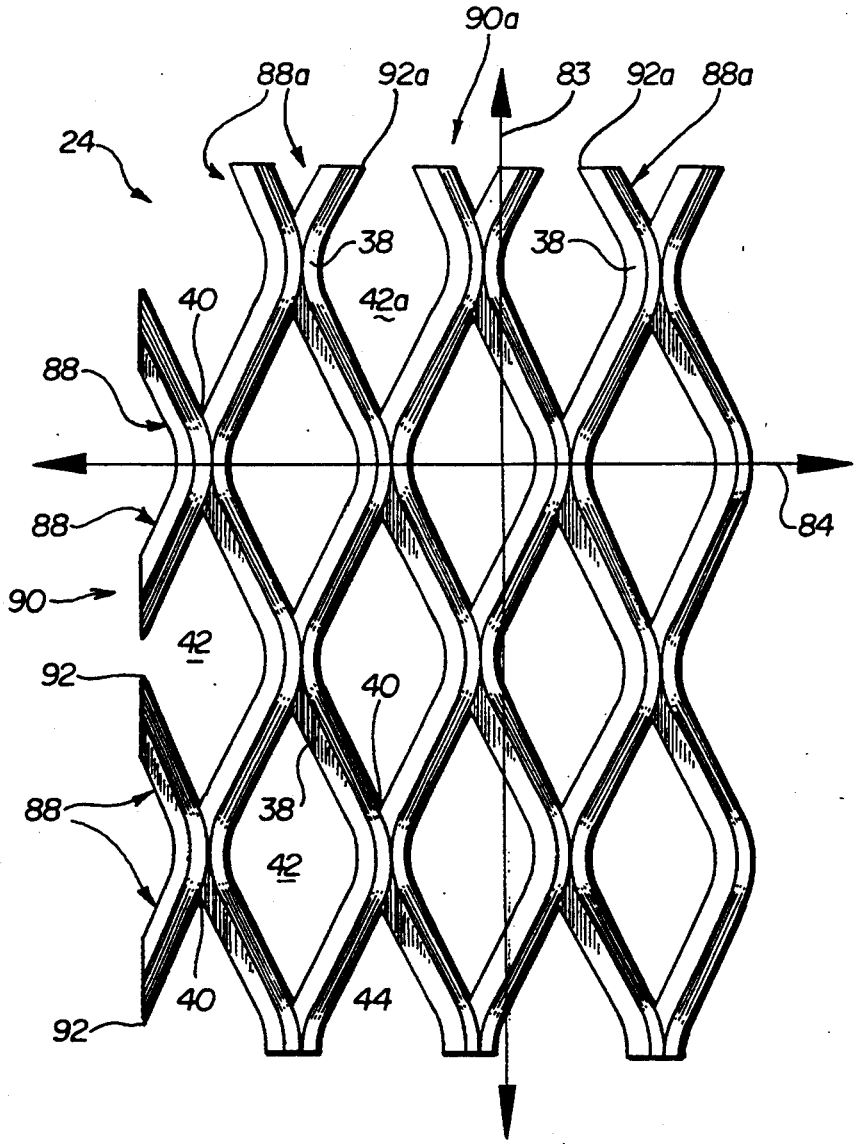
FIG. 10 is an enlarged, partial fragmentary, elevational view of a portion of a terminal edge of a foraminous panel showing barbed segments formed by shearing a strand to provide pointed tips on the ends of the barbed segments.

FIG. 10 provides an enlarged illustration of a representative section of panel 24 each side of which is prepared in one of the four general configurations of the present fence system 20. A first terminal edge 90 having barbed segments 88 disposed thereon is shown on the left side of FIG. 10. The barbed segments 88 include a severely pointed tip 92 extending along the first terminal edge 90. The barbed segments 88 and pointed tips 92 are formed by "random" shearing a panel 24 along an integral strand 38 spaced away from a series of integral bonds 40. By cutting the integral strand 38 at a distance away from the corresponding integral bonds 40, the cell aperture 42 is no longer a closed aperture. It should be noted that the barbed segments 88 have an end opposite the tip 92 which remain intact and integral with the integral bonds 40 of the neighboring integral strand 38.

The top side of FIG. 10 illustrates a second terminal edge 90*a*. The features of the second terminal edge 90*a* corresponding to the features of the first terminal edge 90 are identified with an alphabetic suffix. The second terminal edge 90*a* is formed in a similar manner as the first terminal edge 90. The second terminal edge 90*a* is used along the tops of the vertically oriented panels 24 as shown in FIGS. 1, 2, 6, and 9. The second terminal edge 90*a* includes a second barb segment 88*a* having second pointed tips 92*a*. As a result of random shearing the cell apertures 42 generally parallel to the direction of expansion 84, the resulting barb segments 88*a* are very sharp and provide a climbing deterrent. The right and bottom sides of FIG. 10 show closed shear edges.

An additional climbing deterrent is provided in an unsecured and unsupported top strip 94 on the top cap 78. The top strip 94 is formed by bending the top cap panels 86. The top strip 94 provides a further deterrent in that even if an intruder is capable of climbing the lower panels 82 and an angled portion 96 of the top cap 78 the top strip 94 will give way since it is unsupported. The top strip 94 will not bend or flex under normal environmental conditions but will flex under the weight of a climber. If a climber is unable to be supported by the top strip 94, the climber will not be able to overcome the top cap 78 and will be prevented from climbing over the terminal edge 90.

In use, the fence system 20 of the present invention includes the panels 24 mounted to the frame 22 with an overlapping area 36 between neighboring panels 24. The panels 24 are secured to the frame 22 using appropriate fittings 48,49*a*,49*b* which attach around the posts and rails 26,28 of the frame 22 and are secured thereto using the fasteners 46 and nuts 57. As shown in FIGS. 1–3, the nuts 57 are positioned on the secure side 34 of the barrier 30 with the heads 52 of the fasteners 46 on the attack side 32 thereby reducing opportunities for intruders to break or otherwise force the fasteners 46 from the panels 24.

The panels 24 are positioned with an overlapping area 36 in which the integral strands 38*a* of a first panel 24*a* nest with the integral strands 38*b* of a second panel 24*b*. The fasteners 46 are inserted through the cell aperture of the nested panels 24*a*, 24*b*, with the shoulder 54 engaging an inside surface 44 of the cell aperture 42. The shoulder 54 is sized and dimensioned to prevent rotation of the fastener 46 and the cell aperture 42.

The fastener 46 head 52 has a convex surface 64 which prevents gripping and an abutting surface 60 which abuts crests 62 of the strands 38. When the head 52 is drawn tightly against the panel 24, the head 52 prevents access to the shank 50 thereby preventing removal of the head and disassembly of the fastener 46. Additionally, by positioning the head 52 on the attack side 32, the additional material of the shoulder 54 further reinforces the fastener 46 to prevent forcible removal of the head 52.

The fence system 20 of the present invention is also "retrofittable" onto existing chain link fences. The frame 22 is already in place to support the woven fence material 70. Panels 24 are positioned on the attack side 32 with overlapping areas 36 and are attached to the frame 22 and to the woven fence material 70. The bracket 72 is positioned on the secure side 34 and attached with a fastener 46. The arms 76 extending from the bracket 72 overlie and engage the independent, interlinkable pickets 74 of the woven fence material 70 to secure the panels 24 thereto.

The fence system 20 of the present invention provides a reliable and highly impenetrable barrier against intrusion. While almost any fence can be climbed or penetrated, given sufficient time, the present fence system 20 is essentially impenetrable or climbable in a sufficiently short time period to avoid detection and apprehension. The construction of the panels prevents penetration because it is almost impossible, within a practical time period, to cut or torch a sufficiently large hole through a panel 24. In order to cut through the panel 24, 40–70 individual cuts must be made through the integral strands 38 or bonds 40 to provide even a small "man-sized" hole. Torching through the material requires as many cuts and there is on thermal wave effect to speed up the cutting process because the integral strands 38 and bonds 40 are spaced apart.

The material used in the panels 24 results in a rigid, generally self-supporting panel 24 which conveys an impressive security appearance. In other words, the panels 24 are rigid surfaces which do not shake or flex in the same manner as chain link fence. The fasteners 46 are constructed to prevent removal from the panel 24 and therefore prevents disassembly of the panels 24 from the frame 22. Further, the vertical orientation of the integral strands 38 prevents climbing. As an additional matter, by fabricating the foraminous panels 24 by expanding a continuous sheet of metal each exposed edge of each strand 38 is formed has a sharpened edge. The sharpened edge is work hardened during the forming process and thus retains its edge over a long period of time.

The present invention provides the impressive security appearance as discussed hereinabove while providing visibility through the cell apertures 42. Additionally, the present fence system 20 is uncomplicated and easy to assemble and substantially troublesome to penetrate or scale. It is expected that intruders encountering the fence system 20 of the present invention will forego attempts to penetrate the system and seek security systems which are easier to foil.

While an embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A fence system comprising a plurality of foraminous panels being attachable to a frame;

a plurality of integral strands and integral bonds forming each of said panels, neighboring ones of said plurality of integral strands being connected at spaced apart locations by said integral bonds, at least two neighboring integral strands abutting and being attached to said frame with said integral strands being generally vertically oriented;

cell apertures being defined between neighboring ones of said integral strands and at least two of said integral bonds, said cell apertures defining a non-circular interior shape;

a plurality of fasteners, each fastener of said plurality of fasteners having a shank and a head formed on one end of said shank, said head having a convex surface distal said shank, a shoulder of said fastener positioned on said fastener between said shank and said head being formed for extending through and engaging an inside surface of one of said cell apertures and preventing rotation of said fastener when engaged with said cell aperture, a retaining portion attachable to said shank for securing each of said fasteners to said panel;

a barrier being defined by said plurality of panels being attached to said frame, said barrier having an attack side and a secure side; and neighboring panels of said plurality of panels having an overlapping area, said neighboring panels being oriented for aligning corresponding ones of said cell apertures of said overlapping area, at least one of said plurality of fasteners extending through said aligned corresponding ones of said cell apertures for attaching said neighboring panels, said head of said fastener extending from said attack side of said barrier.

2. A fence system as recited in claim 1, wherein said panels are rigid and self-supporting.

3. A fence system as recited in claim 1, wherein each panel of said plurality of panels are formed by selectively separating areas of a sheet of material to form said integral strands and said integral bonds, said integral strands and integral bonds defining said cell apertures, said integral strands being axially elongated, a direction of expansion being defined generally perpendicularly to said integral strands.

4. A fence system as recited in claim 3, further comprising lower foraminous panels being attached to said frame and an angled top cap being attached proximate to and extending from said lower foraminous panels, said angled top cap being formed of foraminous panels having a direction of expansion oriented generally perpendicular to a direction of expansion of said lower foraminous panels.

5. A fence system as recited in claim 4, further comprising a terminal edge of said top cap, pointed tips extending from said terminal edge for deterring intrusion over said terminal edge.

6. A fence system as recited in claim 5, further comprising barb segments, said barb segments being formed by shearing said foraminous panel along a selected one of said integral strands spaced away from said integral bonds connecting said selected integral strand to a neighboring strand, a first end of each of said barb segments defining said pointed tip and a second end of said barb segment being integral with a corresponding one of said integral bonds.

7. A fence system as recited in claim 4, wherein said apertures in said foraminous panel of said angled top cap are sized smaller than apertures in said foraminous panels of said lower panels.

8. A fence system as recited in claim 1, wherein abutting integral strands in said overlapping area of said neighboring panels nest when said cell apertures of said neighboring panels are aligned, said nesting of said integral strands facilitating interengagement of said neighboring panels.

9. A fence system as recited in claim 1, with said fence system further comprising:

a fitting attachable to said panel;

said fitting including at least one elongated fitting band having two apertures formed therethrough at spaced apart locations;

fasteners for extending through said panel and engaging said at least one fitting band for fixably attaching said band to said panel; and a nut attachable to each of said fasteners for retaining each of said fasteners and said fitting band in engagement with said panel.

10. A fence system as recited in claim 1, further comprising said head of said fastener being sized and dimensioned for overlapping at least two of said integral bonds to prevent access to said shank.

11. A fastener in combination with a foraminous panel fence system, said fence system being attachable to a frame and a plurality foraminous panels attached to said frame and defining a barrier surface, said barrier surface having an attack side and a secure side, said foraminous panels including a plurality of integral strands and integral bonds, cell apertures being defined between neighboring one of said integral strands and at least three spaced apart integral bonds, said cell apertures defining a non-circular interior shape;

said fastener comprising:

a shank, a head formed on one end of said shank, and a shoulder of said fastener positioned between said shank and said head, said shoulder being formed, sized and dimensioned for projecting into and engaging an inside surface of one of said cell apertures of said foraminous panels and preventing rotation of said fastener when engaged with said cell aperture, a retaining portion attachable to said shank for securing said fastener to said panel.

12. A fastener in combination with a foraminous panel fence system as recited in claim 11, wherein said head of said fastener extends from said attack side of said barrier, said fastener further comprising:

an abutting surface of said head abutting and overlying portions of at least two of said neighboring integral strands defining said cell aperture into which said fastener projects, said abutting surface preventing access to said shank for preventing removal of said head from said shank.

13. A fastener in combination with a foraminous panel fence system as recited in claim 11, further comprising:

a convex surface of said head being formed thereon opposite said abutting surface and extending from said attack side of said barrier for preventing gripping of said head from said attack side to prevent removal of said fastener from said panel.

14. A fastener in combination with a foraminous panel fence system as recited in claim 11, wherein said shoulder of said fastener is diamond shaped for engaging a cooperatively shaped cell aperture, said cell aperture having a major axis and a minor axis with said major axis being greater than said minor axis, said diamond shaped shoulder having a first and second axis, said second axis having a dimension being substantially equal to said minor axis and said first axis having a dimension ranging from substantially equal to said minor to substantially equal to said major axis.

15. A fence system for attaching fence panels over an existing woven fence system of the type having a plurality of interlinking pickets defining a woven material and a frame to which said woven material is attached, said fence system comprising:

a plurality of foraminous panels overlying and attaching to said woven material and said frame;

a plurality of integral strands and integral bonds forming each of said foraminous panels, neighboring ones of said plurality of integral strands being connected at spaced apart locations by said integral bonds with said integral strands being generally vertically oriented;

cell apertures of said foraminous panels being defined between neighboring integral strands and at least two spaced apart integral bonds;

a plurality of fasteners for attaching said panels to said existing woven material, said plurality of fasteners having a shank and a head formed on one end of said shank, said shank being formed for extending through one of said cell apertures and a corresponding opening between two neighboring interlinking pickets of said woven material, said head being sized and dimensioned for abutting said integral strands to prevent passage through said cell aperture;

a bracket being engaged by at lest one of said fasteners, at least two arms extending from said bracket, each of said at least two arms extending from said bracket and overlying at least one picket of said woven material for securing said panel to said woven material;

neighboring panels of said plurality of panels having an overlapping area, said neighboring panels being oriented for aligning corresponding cell apertures of said overlapping areas of said neighboring panels, at least one of said fasteners extending through a corresponding one of said aligned corresponding cell apertures for attaching said neighboring panels to each other.

16. A fence system as recited in claim 15, further comprising:

said cell apertures defining an interior surface having a non-circular interior shape;

a shoulder on said fastener positioned between said head and said shank, said shoulder engaging said interior surface of one of said cell apertures and preventing rotation of said fastener when engaged with said cell aperture.

17. A fence system as recited in claim 15, wherein said panels are formed by selectively separating areas of a sheet of material to form said integral strands and said integral bonds, said integral strands and bonds defining cell apertures, a direction of expansion of said panels being defined generally perpendicularly to said integral strands.

18. A fence system as recited in claim 15, wherein abutting integral strands in said overlapping area of said neighboring panels nest when said cell apertures are aligned, said nesting of said integral strands facilitating interengagement of said neighboring panels.

19. A fence system as recited in claim 15, with said fence system further comprising:

a fitting attachable to said panel;

said fitting including at least one elongated fitting band having two apertures formed therethrough at spaced apart locations;

fasteners for extending through said panel and engaging said at least one fitting band for fixably attaching said band to said panel; and a nut attachable to each of said fasteners for retaining each of said fasteners and said fitting band in engagement with said panel.

20. A fence system as recited in claim 15, further comprising said head being sized and dimensioned for overlapping at least two neighboring integral bonds to prevent access to said shank.

21. A bracket assembly in combination with a foraminous fence panel system for attaching foraminous fence panels to an existing woven fence system of the type having a plurality of interlinking pickets defining a woven material and a structural frame to which said woven material is attached, said bracket assembly comprising:

at least one fastener having a shank and a head formed on one end of said shank, said shank being formed for extending through one of said non-circular apertures in said foraminous panel and a corresponding opening between two neighboring interlinking pickets of said plurality of interlinking pickets of said woven material, said head being sized and dimensioned for abutting said foraminous panel to prevent passage through said aperture;

a bracket portion engaging said existing woven material, said fastener extending through said panel and said existing woven material for engaging said bracket portion, at least two arms extending from said bracket portion overlying at least one of said interlinking pickets of said existing woven material for securing said panel to said woven material.

22. A bracket assembly in combination with a foraminous fence panel system as recited in claim 21, further comprising:

a shoulder on said fastener positioned between said head and said shank, said shoulder engaging an inside surface of one of said non-circular apertures of said foraminous panels and preventing rotation of said fastener when engaged with said non-circular aperture.

23. A bracket assembly in combination with a foraminous fence panel system as recited in claim 21, further comprising said head being sized and dimensions for overlapping at least two neighboring integral bonds to prevent access to said shank.

* * * * *

UNITED STATES PATENT AND TRADEMARK OFFICE

CERTIFICATE OF CORRECTION

PATENT NO. : 5,421,557

DATED : June 6, 1995

INVENTOR(S) : Larry L. Vise

It is certified that error appears in the above-indentified patent and that said Letters Patent is hereby corrected as shown below:

Title page, item
56 References Cited

FOREIGN PATENT DOCUMENTS

"215001 5/1961 Australia" should be
--215001 5/1961 Austria --

Signed and Sealed this

Nineteenth Day of November, 1996

Bruce Lehman

*Attest:*

BRUCE LEHMAN

*Attesting Officer*

*Commissioner of Patents and Trademarks*